US006033304A

United States Patent [19]

Haynes

[11] Patent Number: 6,033,304

[45] Date of Patent: Mar. 7, 2000

[54] REGISTER AND METHOD OF ASSEMBLY

[75] Inventor: Gerald D. Haynes, Elkhart, Ind.

[73] Assignee: Continental Industries, Inc., Elkhart, Ind.

[21] Appl. No.: 09/102,958

[22] Filed: Jun. 23, 1998

Related U.S. Application Data

[60] Provisional application No. 60/063,880, Oct. 31, 1997.

[51] Int. Cl.[7] ..... F24F 13/15

[52] U.S. Cl. ..... 454/290; 454/325

[58] Field of Search ..... 454/290, 313, 454/318, 325, 335

[56] References Cited

U.S. PATENT DOCUMENTS

| | | | |
|---|---|---|---|
| 257,107 | 4/1882 | Tobey . | |
| 2,165,593 | 7/1939 | Meulen et al. | 454/290 |
| 2,342,877 | 2/1944 | Maage, Jr. . | |
| 2,600,934 | 6/1952 | Spieth | 454/313 |
| 3,680,470 | 8/1972 | Neece | 454/313 |
| 3,955,483 | 5/1976 | Sunter . | |
| 4,345,510 | 8/1982 | Sterett . | |
| 4,592,535 | 6/1986 | Magill et al. . | |
| 5,042,368 | 8/1991 | Müller et al. . | |
| 5,338,256 | 8/1994 | Tonna . | |
| 5,573,458 | 11/1996 | Chu . | |
| 5,586,934 | 12/1996 | Dombrowski et al. . | |

*Primary Examiner*—Harold Joyce
*Attorney, Agent, or Firm*—Barnes & Thornburg

[57] ABSTRACT

A register includes a faceplate having a central area with openings to permit air flow, a box-like housing attached to one side of the faceplate including walls extending about the periphery of the central area, and adjustable dampers supported within the housing between opposed walls for controlling the amount of air flow through the register. The dampers are connected to an adjustment wheel mounted to one of the housing walls. As the adjustment wheel is rotated, a spring member connected between the adjustment wheel and the dampers causes the dampers to rotate about pivot rods extending from each end of the dampers through opposed housing walls. The dampers are assembled into the housing by inserting one pivot rod through a bore in one wall and moving the other pivot rod along an opposed wall within a guide channel which guides the pivot rod into registration with a bore in the opposed wall. When the pivot rod registers with the bore, the biasing force of the opposing member coupled to the damper causes the damper to shift toward the opposed wall so that the pivot rod slides through the bore at the end of the guide channel.

43 Claims, 4 Drawing Sheets

58
46
86
94
40
64
68
16
57
88
76
54
56
30
10
60
98
104
72
96
48

20
46
22
68
62
88
86
18
54
44
32
30
34
10
10
48
104
98
72
14
104

REGISTER AND METHOD OF ASSEMBLY

This application claims the benefit of U.S. Provisional Application No. 60/063,880, filed Oct. 31, 1997.

BACKGROUND OF THE INVENTION

The present invention relates to a register for controlling the flow of air through an opening and a method for assembling the register.

It is desirable to provide a register for flush mounting to a wall, floor, or ceiling of an interior space at an opening into the interior space to direct the flow of air into and out of the interior space. It is also desirable to provide adjustability of such a register so that the user can control the flow of air through the opening. Such control may be provided by adjustable dampers which are movable relative to the register body. Movable dampers, however, tend to vibrate in response to air flow. Accordingly, movable dampers should be assembled into the register body so that they provide adjustability, but are not easily removable or prone to vibrate during operation. Additionally, it is desirable that such movable dampers, and the register assembly which receives them, be configured for quick and easy assembly.

SUMMARY OF THE INVENTION

The present invention provides a register having adjustable dampers. The register includes a faceplate with a central area having fins and openings to permit air flow through the faceplate. A box-like housing is attached to one side of the faceplate. The housing includes four walls which are attached to the margins of the faceplate between the edges of the faceplate and the central area. The dampers are generally flat blades with rods extending from each end. Each rod fits within a bore disposed on two opposed walls.

The dampers are interconnected and coupled to an adjustment wheel by a spring member. The adjustment wheel is attached to one of the opposed walls. As the adjustment wheel is rotated, the spring member causes the damper blades to pivot about the rods, thereby moving the blades between a fully opened position and a fully closed position.

The other opposed wall includes integrally formed channels which slant outwardly away from the dampers with distance from the faceplate. One of the rod receiving bores is disposed at the lower end of each channel adjacent to the faceplate. The dampers are inserted into the register housing, between the opposed walls, by first inserting the rods into the bores of the wall carrying the adjustment wheel, thereby coupling the dampers to the adjustment wheel, and then placing the other rod into an integral guide channel on the opposed wall. The other end of each damper is then urged downwardly within the guide channel toward the faceplate. The spring member coupled to the first end of each damper blade biases the damper blade toward the guide channel. When the end rod registers with the bore disposed at the lower end of the guide channels, the biasing force of the spring member causes the rod to snap into place, extending through the bore. With the damper blades securely biased into place, vibration is minimized.

Other features of the present invention will become apparent upon consideration of the following description of embodiments of the invention in conjunction with the accompanying drawings.

DESCRIPTION OF EMBODIMENTS OF THE INVENTION

The embodiments described herein are not intended to be exhaustive or to limit the invention to the precise forms disclosed. Rather, the embodiments selected for description are disclosed so that others skilled in the art may utilize their teachings.

Figure 1:
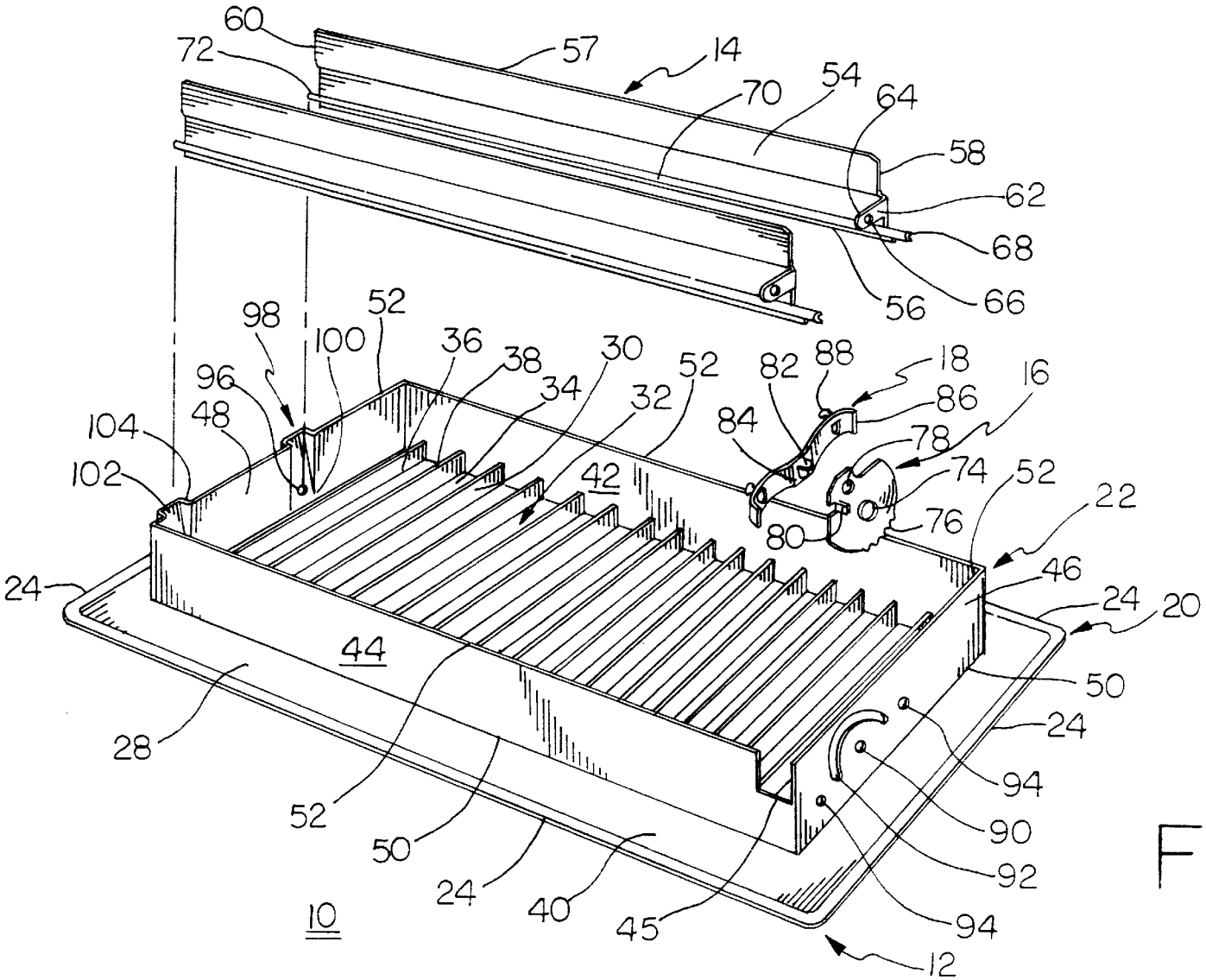
FIG. 1 is an exploded, perspective view of a register according to the present invention.

FIG. 1 shows an exploded, perspective view of a register assembly according to the present invention. Register 10 generally includes a register body 12, a damper 14 or a plurality of dampers 14 as the case may be, an adjustment wheel 16, and a spring member 18. Register body 12 generally includes a faceplate 20 and box-like housing 22.

Faceplate 20 may be substantially planer and rectangular in shape having outer edges 24, an exterior side 26, and an interior side 28. A plurality of fins 30 extend across a central area 32 of faceplate 20. Fins 30 are substantially parallel to one another, defining between them a plurality of openings 34. Fins 30 have one edge 36 which is substantially planer with the plane of faceplate 20 and another opposed edge 38. The body of each fin 30 extends in a substantially perpendicular relationship to the plane of faceplate 20. A margin area 40 is defined between outer edges 24 of faceplate 20 and central area 32.

Housing 22 includes a pair of side walls 42, 44, end wall 46 and opposed end wall 48. Side wall 44 includes a notch 45 as will be described in greater detail below. Side walls 42, 44 and end walls 46, 48 may be bent from a single piece of metal or otherwise connected together to form the box-like structure illustrated in the figures. One edge 50 of each of the housing walls is connected, such as by welding, to margin 40 of interior side 28 of faceplate 20. The other edge 52 of each of the walls of housing 22 defines the outer boundary of the box-like structure.

Each damper 14 includes a substantially flat blade 54 having an upper edge 57 and a lower edge 56. A rib 70 is formed along lower edge 56 of the blade extending from one end 58 of the blade to the other end 60 of the blade. Each end 58, 60 of each blade 54 includes an actuator arm 62 which extends at a right angle from a plane of the blade 54. The outer end 64 of each actuator arm 62 includes an opening 66. End 58 of blade 54 also includes a pivot rod 68 which extends longitudinally from rib 70. Similarly, a pivot rod 72 extends from rib 70 at other end 60 of blade 54.

Adjustment wheel 16 is substantially circular and includes a centrally located pivot bushing 74 for mounting adjustment wheel 16 to end wall 46 of housing 22 as described in further detail below. Adjustment wheel 16 includes a gripping surface 76 along one portion of its outer edge, and a connection bore 78 and stop tab 80 disposed adjacent an opposite portion of adjustment wheel 16.

Spring member 18 includes a centrally located connector tab 82 which extends in one direction perpendicularly away from a central portion 84 of the spring member. A pair of arms 86 extend at an angle from central portion 84. The outermost portions of arms 86 are curved or bowed and carry actuator tabs 88 which extend in a direction opposite to connector tab 82.

End wall 46 of housing 22 includes a pivot hole 90 for receiving the pivot bushing 74 of adjustment wheel 16, and a slot 92 which forms an arc of a constant radius relative to pivot hole 90 for receiving stop tab 80 and connector tab 82. End wall 46 also includes supports, which in this embodiment, are shown as bores 94 for receiving pivot rods 68 of dampers 14. Of course, bores 94 could be replaced with indentations or detents or an equivalent structure.

End wall 48 also includes supports (bores 96) which are aligned with bores 94 to support dampers 14 in parallel relationship with side walls 42, 44. End wall 48 includes integral guide channels, generally designated 98, which diverge outwardly from the plane of end wall 48 with distance from faceplate 20. A bore 96 is disposed at the inner end 100 (adjacent faceplate 20) of each guide channel 98. Each inner end 100 is substantially planer with the plane of end wall 48. The outer end 102 is offset outwardly from end wall 48, away from central area 32. Each guide channel 98 also includes a pair of side walls 104 which taper from a width of zero at inner end 100 to a maximum width at outer end 102.

Referring now to FIGS. 2 through 5, a fully assembled register 10 is shown. Dampers 14 extend between housing end walls 46, 48 with pivot rods 68, 72 extending through bores 94, 96. Actuator arms 62 of damper blades 54 interconnect with spring member 18 at arms 86. Specifically, actuator tabs 88 on spring arms 86 extend through openings 66 at outer ends 64 of blade actuator arms 62.

Figure 3:
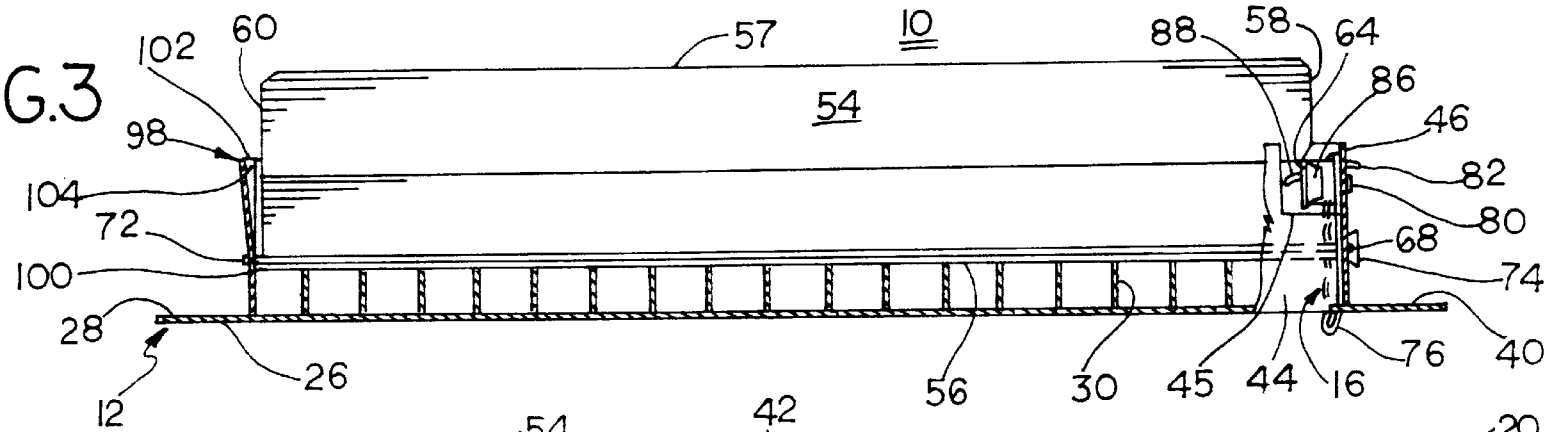
FIG. 3 is a cross-sectional view taken substantially along line 3—3 of FIG. 2.
Figure 2:
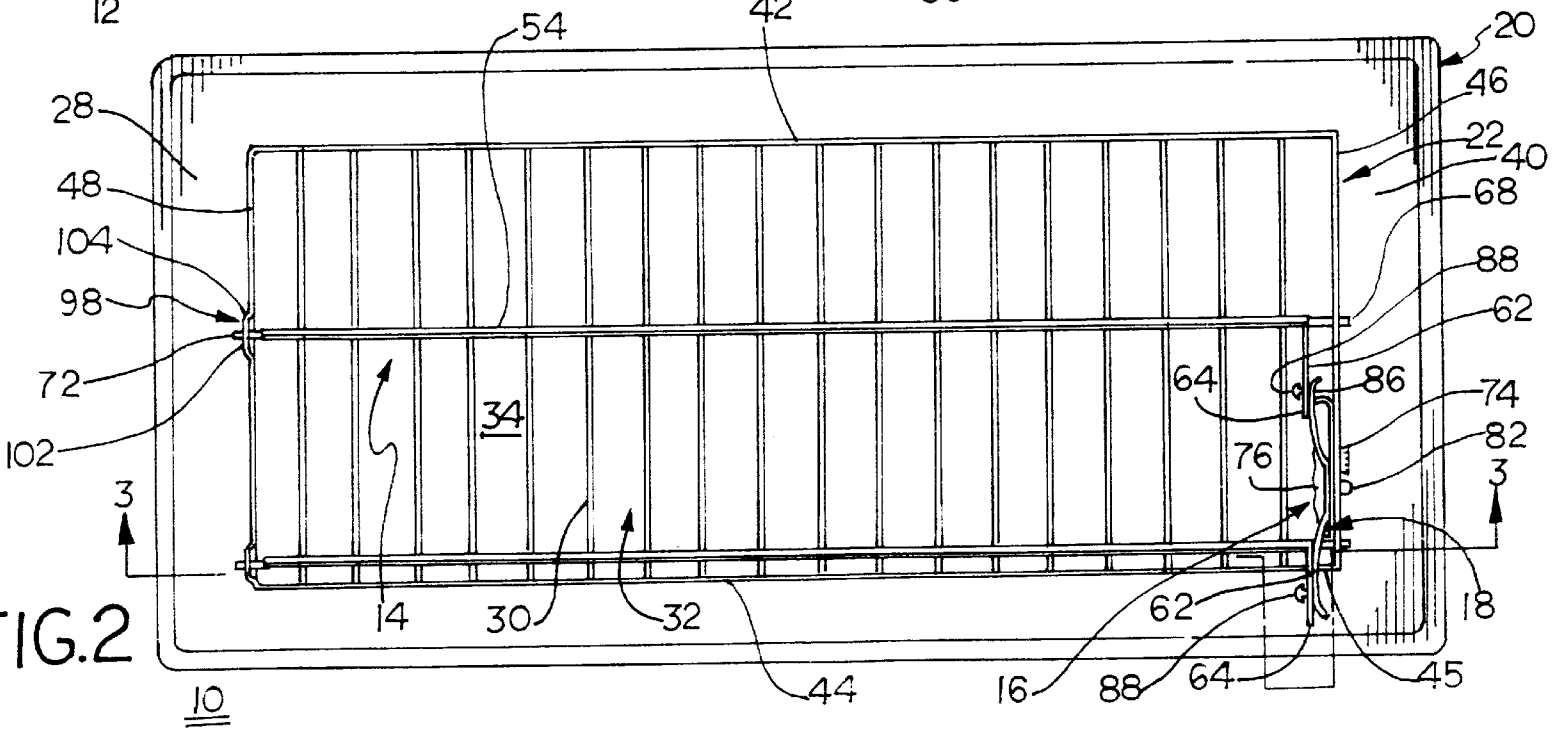
FIG. 2 is a bottom, elevational view of a fully assembled register according to the present invention.

Spring member 18 is coupled to adjustment wheel 16 which is mounted on housing end wall 46. Connector tab 82 of spring member central portion 84 extends through connection bore 78 in adjustment wheel 16. Connector tab 82 also extends through slot 92 formed in end wall 46. Similarly, stop tab 80 of adjustment wheel 16 extends through slot 92. Pivot bushing 74 of adjustment wheel 16 extends through pivot hole 90. As best shown in FIGS. 2 and 3, bushing 74 is flared after installation through pivot hole 90 so that bushing 74 can rotate within pivot hole 90, but adjustment wheel 16 will remain securely attached to end wall 46.

Figure 5:
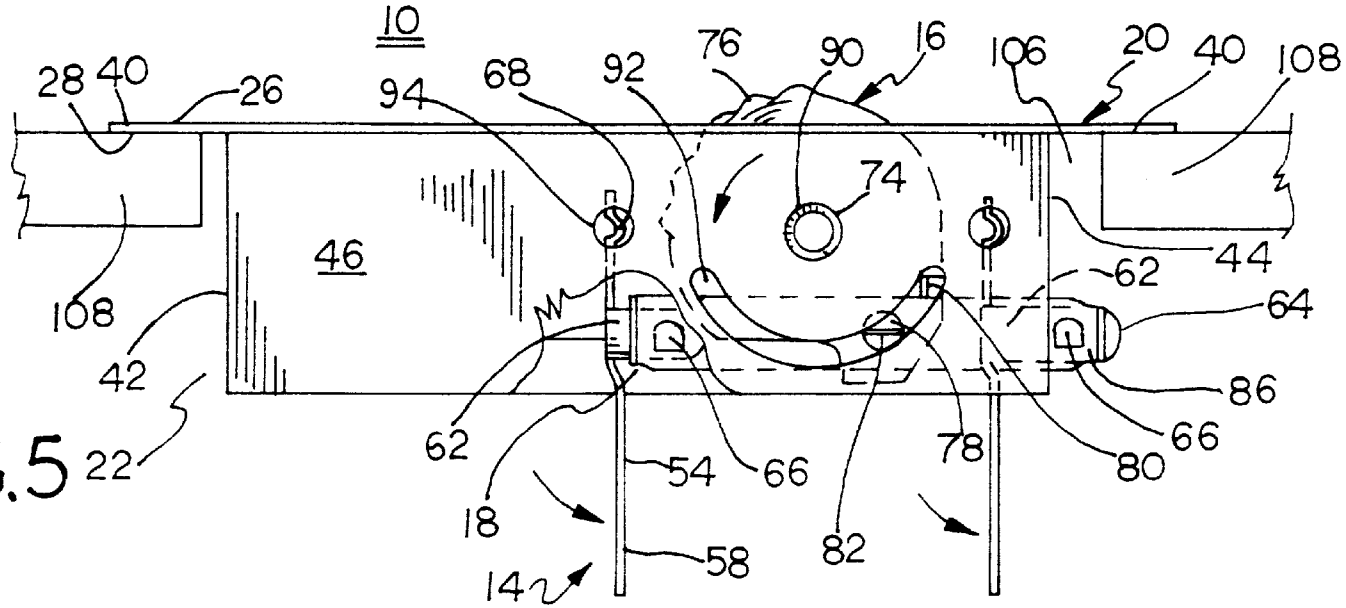
FIG. 5 is a view similar to FIG. 4, depicting the damper blades in a fully opened position.
Figure 4:
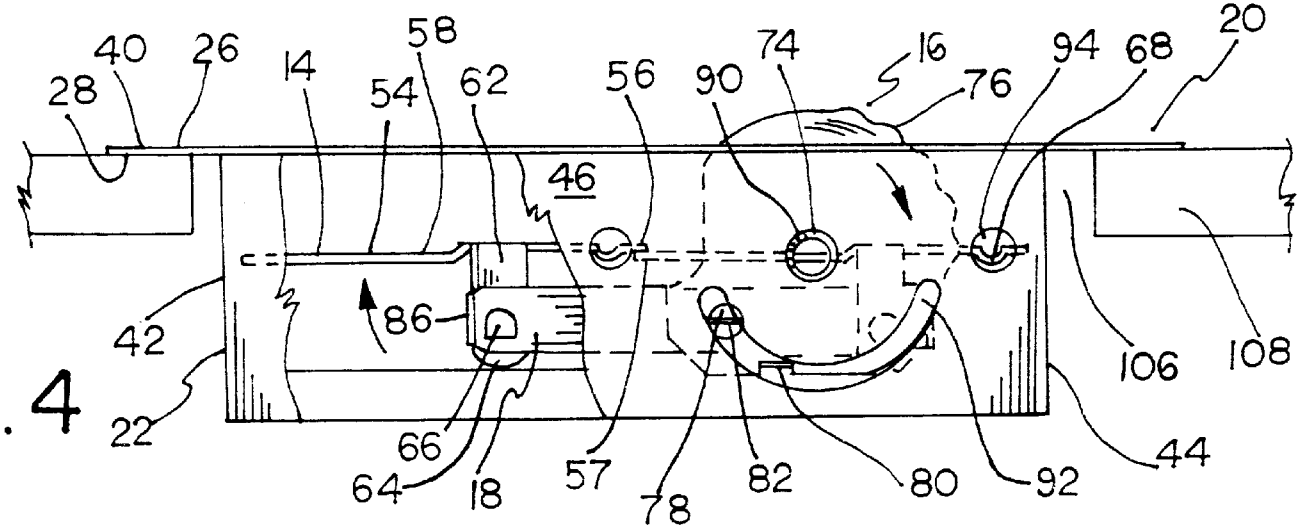
FIG. 4 is a fragmented, side elevational view of a register according to the present invention depicting the damper blades in a fully closed position.

FIGS. 4 and 5 illustrate the operation of register 10. Once assembled, register 10 is fitted through an opening 106 in a wall 108, such as through a floor, wall or ceiling, which is sized to receive register housing 22. Margin 40 of faceplate 20 rests against or is attached to wall 108 at the perimeter of opening 106. Once register 10 is attached to wall 108 in the above-described manner, the only path for airflow through opening 106 is through the plurality of openings 34 in central area 32 of faceplate 20. The amount of airflow through openings 34 is controllable by adjusting the position of dampers 14 between a fully closed position as shown in FIG. 4, and a fully opened position as shown in FIG. 5. When in the fully closed position, dampers 14 form a substantially continuous wall which obstructs or covers the plurality of openings 34. Specifically, upper edge 57 of one damper 14 overlaps lower edge 56 of the adjacent damper 14, and both blades 54 are supported between end walls 46, 48 in a substantially parallel orientation relative to faceplate 20.

Dampers 14 are adjustable between the closed position (FIG. 4) and the opened position (FIG. 5) by turning adjustment wheel 16 using gripping surface 76. As adjustment wheel 16 rotates, connector tab 82 of spring member 18 is carried along an arcuate path within slot 92 by connector bore 78 as bore 78 rotates about bushing 74. As connector tab 82 is moved toward side wall 44 of housing 22, spring member 18 is likewise carried toward side wall 44. Since actuator tabs 88 of spring member 18 extend through openings 66 and are thereby interconnected with actuator arms 62 of dampers 14, spring member 18 urges actuator arms 62 toward side wall 44. Since actuator tabs 88 can rotate within openings 66 and pivot rods 68, 72 can rotate within bores 94, 96, the moment arm formed by actuator arm 62 results in the pivotal movement of blade 54 about pivot rods 68, 72.

When damper blades 14 are rotated into the fully opened position shown in FIG. 5, stop tab 80 engages one end of slot 92. In this position, damper blades 54 are substantially perpendicular to faceplate 20, thereby permitting essentially unobstructed flow of air through plurality of openings 34 through faceplate 20. As best shown in FIG. 5, outer end 64 of actuator arm 62 adjacent side wall 44 extends beyond the plane of side wall 44. Notch 45 in side wall 44 (shown in FIGS. 1 through 3) permits this extension.

Figure 6:
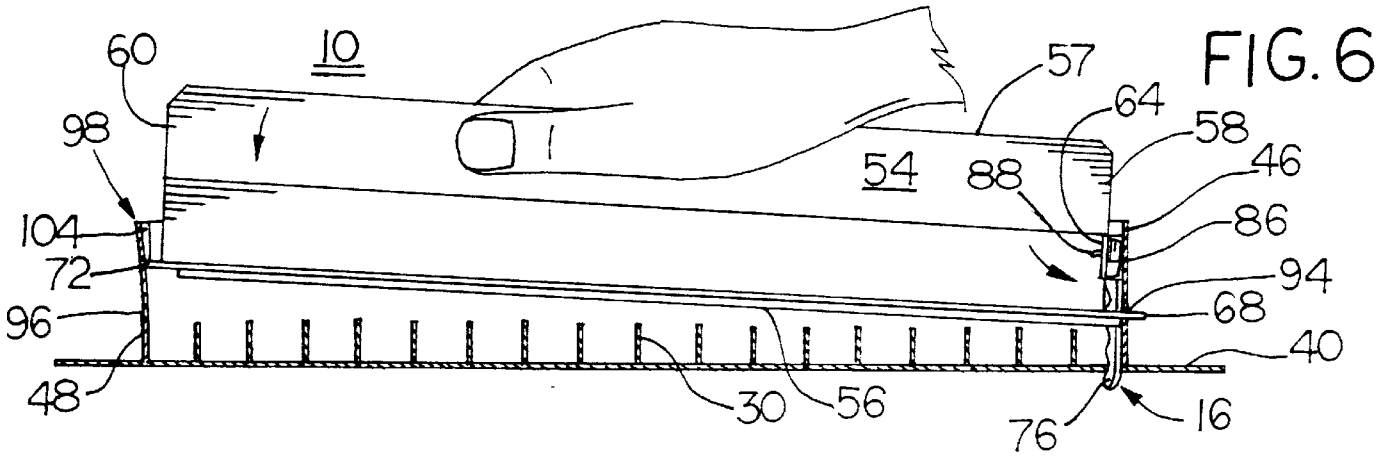
FIG. 6 is a sectionalized, side elevational view of a register according to the present invention depicting the method of installing damper blades into the register housing.
Figure 7:
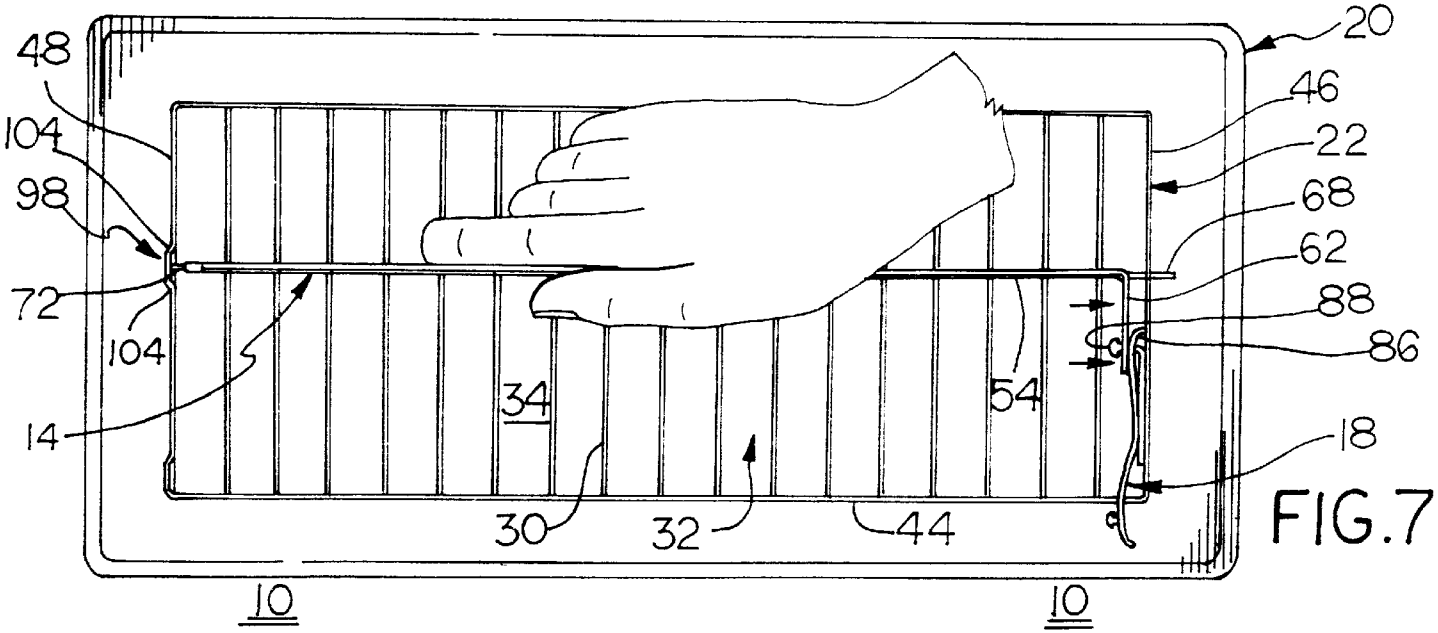
FIG. 7 is a bottom, plan view of a register according to the present invention depicting the method of installing damper blades into the register housing.

The assembly of dampers 14 into housing 22 is illustrated in FIGS. 6 and 7. End 58 of each damper 14 is lowered into housing 22, and pivot rod 68 is passed through bore 94. Damper 14 is moved toward end wall 46 and opening 66 in actuator arm 62 is guided over actuator tab 88 of spring member 18. After damper 14 has been moved into engagement with spring member 18, end 60 is lowered toward housing 22 and pivot rod 72 is placed within guide channel 98. As end 60 is moved toward faceplate 20, pivot rod 72 slides within guide channel 98. The slanted wall of guide channel 98 urges damper 14 toward end wall 46. Pivot rod 68 extends farther through bore 94 and actuator arm 62 moves spring arm 86 toward end wall 46 against the biasing force of spring member 18. When end 60 is moved such that pivot rod 72 reaches inner end 100 of guide channel 98, pivot rod 72 registers with bore 96. The biasing force of spring member 18 acting against actuator arm 62 causes pivot rod 72 to snap through bore 96. Consequently, damper 14 shifts toward end wall 48. With both pivot rods 68, 72 extending through bores 94, 96, damper 14 is supported between end walls 46, 48. The process is repeated for additional dampers 14.

While this invention has been described as having exemplary embodiments, this application is intended to cover any variations, uses, or adaptations of the invention using its general principles. Further, this application is intended to cover such departures from the present disclosure as come within the known or customary practice within the art to which it pertains. The spirit and scope of the invention are to be limited only by the terms of the appended claims.

What is claimed is:

1. A register, comprising:

a housing including a first wall having a first support, a second wall opposite the first wall having a guide channel and a second support disposed at one end of the guide channel aligned with the first support; and a damper supported between the first and second supports the guide channel diverges from the first wall with distance from the one end.

2. A register according to claim 1 wherein the one end of the guide channel is substantially planar with the second wall.

3. A register according to claim 1 wherein the second wall includes a first edge and a second edge, the second support being disposed nearer to the first edge than to the second edge.

4. A register according to claim 3 wherein another end of the guide channel is contiguous with the second edge.

5. A register according to claim 4 wherein the guide channel is tapered such that the other end is spaced farther from the first wall relative to the one end.

6. A register according to claim 1 wherein the guide channel is integrally formed within the second wall.

7. A register according to claim 1 wherein the first wall is parallel to the second wall.

8. A register according to claim 1 wherein the second wall has a length and a height, the length being greater than the height.

9. A register according to claim 8 wherein the guide channel extends substantially perpendicular to the length of the second wall.

10. A register according to claim 1 wherein the first support is a bore.

11. A register according to claim 1 wherein the first and second supports are bores.

12. A register according to claim 1 wherein the damper includes a first pivot rod for rotating within the first support, and a second pivot rod for rotating within the second support.

13. A register according to claim 1 wherein the damper is a substantially rectangular blade.

14. A register according to claim 1 including at least two dampers.

15. A register according to claim 1 wherein the first wall includes at least two first supports, and the second wall includes at least two guide channels and at least two second supports.

16. A register according to claim 1 further comprising a spring member disposed between the first wall and the damper to bias the damper toward the second wall.

17. A register according to claim 1 further comprising an adjustment wheel connected to the housing, the adjustment wheel being coupled to the damper so that movement of the adjustment wheel causes movement of the damper.

18. A register according to claim 17 wherein the adjustment wheel is rotatably mounted to the first wall.

19. A register according to claim 17 further comprising a spring member disposed between the adjustment wheel and the damper, the spring member biasing the damper toward the second wall.

20. A register, comprising:

a housing having an outlet to permit airflow through the register; and a damper extending across the opening, the damper including a first pivot rod and a second pivot rod;

the housing including a support for receiving the first pivot rod and a channel for guiding the first pivot rod into registration with the support during assembly of the register the channel diverging from the opening with distance from the support.

21. A register according to claim 20 wherein the housing includes an end wall including the support and the channel.

22. A register according to claim 21 wherein one end of the channel is substantially planar with the end wall.

23. A register according to claim 21 wherein the end wall includes a first edge and a second edge, the support being disposed nearer to the first edge than to the second edge.

24. A register according to claim 23 wherein another end of the channel is contiguous with the second edge.

25. A register according to claim 24 wherein the channel is tapered such that the other end is spaced farther from the opening relative to the one end.

26. A register according to claim 21 wherein the channel is integrally formed within the end wall.

27. A register according to claim 20 wherein the housing includes a first wall and a second wall being parallel to the first wall, the opening being between the first wall and the second wall.

28. A register according to claim 20 wherein the support is a bore.

29. A register according to claim 20 wherein the housing includes a second support disposed opposite the first support, the second support receiving the second pivot rod.

30. A register according to claim 29 wherein the first and second supports are bores.

31. A register according to claim 20 wherein the damper is a substantially rectangular blade.

32. A register according to claim 20 including at least two dampers.

33. A register according to claim 20 further comprising a spring member disposed between the housing and the damper to bias the damper toward the support.

34. A register according to claim 20 further comprising an adjustment wheel connected to the housing, the adjustment wheel being coupled to the damper so that movement of the adjustment wheel causes movement of the damper.

35. A register according to claim 34 wherein the adjustment wheel is rotatably mounted to the housing.

36. A register according to claim 34 further comprising a spring member disposed between the adjustment wheel and the damper, the spring member biasing the damper toward the support.

37. A method for assembling a register, including a housing having a first wall and an opposed second wall, and a damper having a first end and a second end, the method comprising the steps of:

inserting a first pivot rod connected to the first end of the damper into a first support disposed on the first wall;

positioning a second pivot rod connected to the second end of the damper at one end of a channel disposed on the second wall; and moving the second pivot rod within the channel toward a second support disposed at another end of the channel until the second pivot rod is aligned with the second support, the channel diverging from the first wall with distance from the second support.

38. A method according to claim 37 further comprising the step of placing the first end of the damper into engagement with a spring member which biases the damper toward the channel.

39. A method according to claim 37 wherein the step of moving the second pivot rod includes the step of shifting the damper toward the first support.

40. A method according to claim 38 wherein the step of moving the second pivot rod includes the step of shifting the damper toward the first support against the biasing of the spring member.

41. A method according to claim 37 wherein the step of moving the second pivot rod includes the step of contacting an inclined surface within the channel.

42. A method of installing a damper into a register having a first wall with a support and a second wall with a support opposite the first wall, the method comprising the steps of:

engaging one end of the damper with the support on the first wall; and moving another end of the damper within a guide channel to engage the support on the second wall, the guide channel diverging from the first wall with distance from the support on the second wall.

43. A method according to claim 43 further comprising the step of engaging the one end of the damper with a spring member which biases the damper toward the second wall.

* * * * *